US005539413A

United States Patent [19]

Farrell et al.

[11] Patent Number: 5,539,413

[45] Date of Patent: Jul. 23, 1996

[54] INTEGRATED CIRCUIT FOR REMOTE BEAM CONTROL IN A PHASED ARRAY ANTENNA SYSTEM

[75] Inventors: Patrick Farrell, Baltimore; Jesus Chang, Elkridge; John Monk, Jr., Columbia; David Williams, Ellicott City; Joe Rocco, Columbia; Robert R. Angell, Greenbelt, all of of Md.

[73] Assignee: Northrop Grumman, Los Angeles, Calif.

[21] Appl. No.: 301,201

[22] Filed: Sep. 6, 1994

[51] Int. Cl.[6] ..... H01Q 3/22

[52] U.S. Cl. ..... 342/372; 342/361

[58] Field of Search ..... 342/372, 373, 342/361

[56] References Cited

U.S. PATENT DOCUMENTS

| | | | |
|---|---|---|---|
| 4,520,361 | 5/1985 | Frazita | 343/372 |
| 4,532,517 | 7/1985 | LaBerge et al. | 343/372 |
| 4,532,518 | 7/1985 | Gaglione et al. | 343/372 |
| 4,536,766 | 8/1985 | Frazita | 343/372 |
| 4,862,014 | 8/1989 | Myers et al. | 307/270 |
| 5,283,587 | 2/1994 | Hirshfield et al. | 342/372 |

*Primary Examiner*—Thomas H. Tarcza
*Assistant Examiner*—Dao L. Phan

[57] ABSTRACT

An integrated circuit for use in a phased array antenna system having a central processing unit. The integrated circuit is associated with one of a plurality of antenna elements of the phased array antenna system. The integrated circuit includes an ID memory for storing a unique ID addressable by the central processing unit, and receives global commands from the central processing unit globally transmitted over a distributed serial bus. Upon detecting a global command, the integrated circuit compares an ID address associated with the global commands with the ID stored in the ID memory. The integrated circuit recognizes global commands as local commands to be executed locally when the ID address associated with the global commands is the same as the ID stored in the ID memory. In response to the local commands, the integrated circuit generates and provides control signals to the associated one of the antenna elements of the phased array antenna system.

19 Claims, 2 Drawing Sheets

TX/RX
6 BITS PHASE
5 BITS ATTEN
POLARIZATION
TX ENABLE
RX ENABLE
SWITCH 1
SWITCH 2
MUX
255
MUX
250
RAM A
230
RAM B
235
INPUT CONTROL
220
OUTPUT SHIFT REGISTER
245
INPUT SHIFT REGISTER
225
CMD DECODER
210
OUTPUT CONTROL
240
EEPROM
215
TEMP SENSOR
260
DELAY
271
DELAY
272
DELAY
275
DELAY
276
DELAY
280
DELAY
281
FF
273
FF
277
FF
282
274
278
284
283
270
291
292
293
294
205
CMD
CLK
EN
TA
200

INTEGRATED CIRCUIT FOR REMOTE BEAM CONTROL IN A PHASED ARRAY ANTENNA SYSTEM

BACKGROUND OF THE INVENTION

1. Field of the Invention

The present invention relates to an integrated circuit for remote beam control in a phased array antenna system. More particularly, the present invention relates to an integrated circuit for controlling a corresponding antenna element of a phased array antenna system.

2. Discussion of the Related Art

In advanced radar systems, it is desirable to generate a coherent beam and steer it in space. A control system may accomplish this by adjusting the phase of each antenna element feed relative to the others. To perform this beam steering function as well as other functions, it is preferable to provide remote beam control of the individual antenna elements. However, because radar antenna arrays typically include hundreds, or even thousands, of individual antenna elements, development of a flexible and effective control system including remote beam control has proven problematic.

Further, because it is desirable to keep the antenna array small and compact and because of the large number of antenna elements that must be included in an antenna array, the remote beam control circuitry must be extremely compact. This requirement for compactness limits the inclusion of control features that may be incorporated in the remote beam control circuitry.

SUMMARY OF THE INVENTION

Accordingly, the present invention has been made in view of the above circumstances and has as an object to provide a compact integrated circuit that optimizes the performance of a phased antenna array system.

A further object of the present invention is to provide a remote beam control integrated circuit able to recognize, accept, process, and store individualized commands received from a distributed serial bus.

Another object of the present invention is to provide a remote beam control integrated circuit, which may be programmed while the antenna array is active.

Additional objects and advantages of the invention will be set forth in part in the description which follows and in part will be apparent from the description, or may be learned by practice of the invention. The objects and advantages of the invention may be realized and attained by means of the instrumentalities and combinations particularly pointed out in the written description and claims hereof as well as the appended drawings.

To achieve these and other objects and advantages and in accordance with the purpose of the invention, as embodied and broadly described herein, the integrated circuit of this invention comprises an ID memory for storing a unique ID addressable by a central processing unit of a phased array antenna system, command receiving means for receiving global commands from the central processing unit globally transmitted over a distributed serial bus, for comparing an ID address associated with the global commands with the ID stored in the ID memory, and for recognizing the global commands as local commands to be executed locally when the ID address associated with the global commands is the same as the ID stored in the ID memory, and processing means for generating and providing control signals to an associated one of the antenna elements of the phased array antenna system in response to the local commands.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification illustrate an embodiment of the invention and, together with the description, serve to explain the objects, advantages, and principles of the invention. In the drawings.

DETAILED DESCRIPTION OF THE PREFERRED EMBODIMENTS

Reference will now be made in detail to the present preferred embodiment of the invention, an example of which is illustrated in the accompanying drawings.

Figure 1:
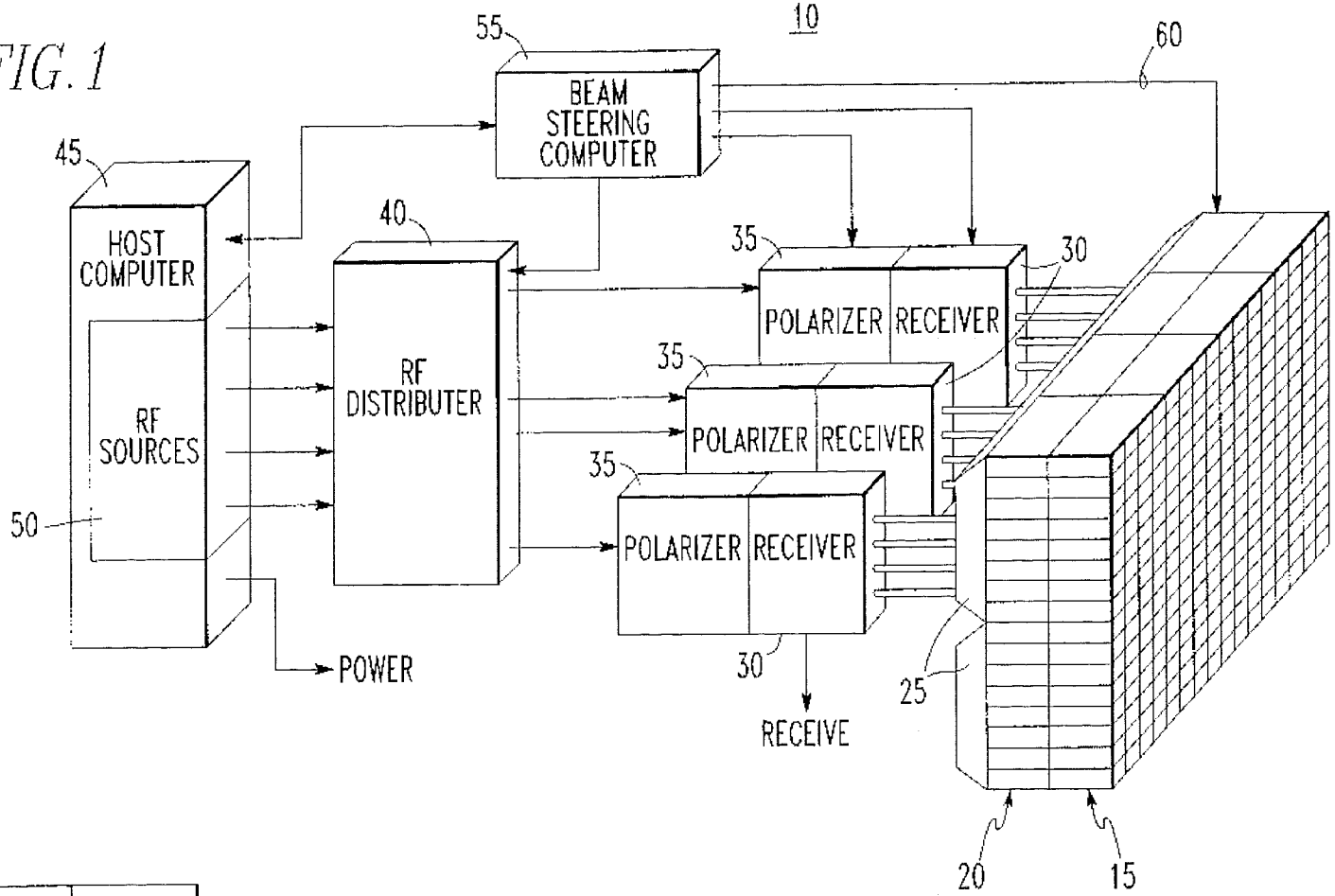
FIG. 1 is a schematic illustration of a phased array antenna system in which the remote beam control integrated circuit of the present invention may be employed.

FIG. 1 shows a phased array antenna system 10 in which the remote beam control integrated circuit of the present invention may be employed. Phased array antenna system 10 generally includes an array of transmit/receive (T/R) modules 15 and associated remote beam control integrated circuits 20, an RF feed 25, receivers 30, polarizers 35, an RF distributer 40, a host computer 45 including RF sources 50, and a beam steering computer 55.

T/R modules 15 use active RF circuitry for the transmit and receive paths at each T/R module 15 in the array. RF sources 50 transmit RF signals to RF distributer 40, which, in turn, transmits distributed RF signals to the polarizers 35. Subsequently, polarizers 35 transmit the RF signals to T/R modules 15. In the receive mode, T/R modules 15 transmit the received signals to receivers 30.

Turning to the control system of phased array antenna system 10, beam steering computer 55 communicates with host computer 45 and controls the operation of RF distributer 40, polarizers 35, receivers 30, and remote beam control integrated circuits 20 to allow coordinated control of transmission and reception.

In the phased array antenna system 10 shown in FIG. 1, the remote beam control integrated circuits 20 preferably govern the control of the phase, gain, and timing events in a coordinated fashion. To accomplish the necessary degree of coordination, beam steering computer 55 sends commands and synchronizing clock signals over a distributed serial bus 60 to the remote beam control integrated circuits 20. To describe the functionality of the control system in more detail, reference will now be made to FIG. 2, which shows the structure of the remote beam control integrated circuit constructed in accordance with an exemplary embodiment of the present invention.

Figure 2:
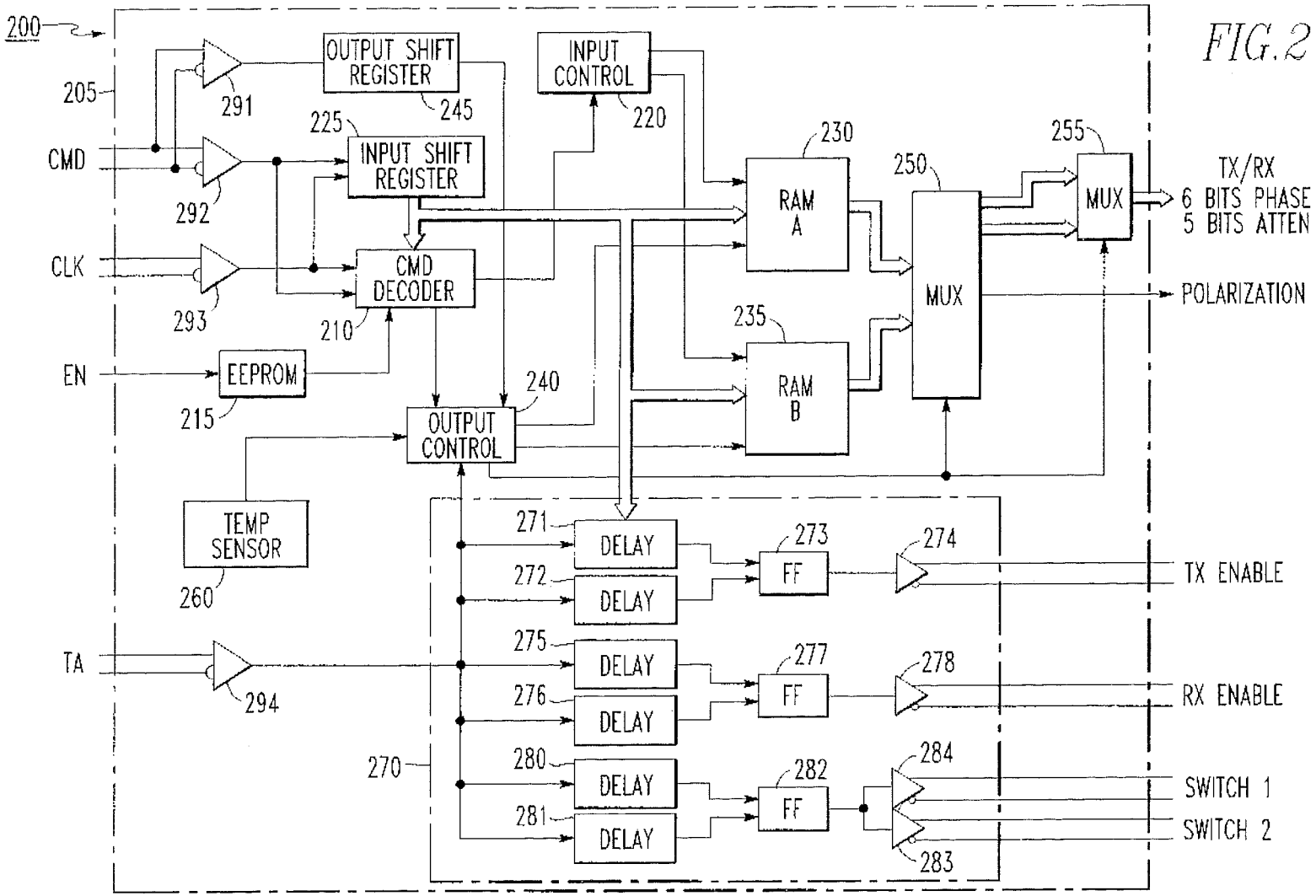
FIG. 2 is a schematic illustration of an embodiment of the remote beam control integrated circuit of the present invention.

Remote beam control integrated circuit is designated in FIG. 2, generally by the reference numeral 200. Remote beam control integrated circuit 200 includes a command (CMD) decoder 210, an ID memory, preferably, a nonvolatile, RAD-hardened EEPROM 215, an input control unit 220, an input shift register 225, a first random access memory (RAM A) 230, a second random access memory (RAM B) 235, an output control unit 240, an output shift register 245, a first output multiplexer (MUX) 250, a second output MUX 255, a temperature sensor 260, and adjustable delay means 270 all of which are provided on a substrate 205.

Preferably, integrated circuit 200 further includes a number of input gates for receiving differential input signals, which are utilized to improve transmission accuracy. The input gates include a first command (CMD) input gate 291, a second command (CMD) input gate 292, a clock input gate 293, and a transmit/receive enable input gate 294.

In operation, remote beam control integrated circuit 200 initially receives an enabling ID address (EN) from a central processing unit of the phased antenna array system 30 and stores the ID address in EEPROM 215. Once the ID address is stored in EEPROM 215, the central processing unit does not change the ID address unless the remote beam control integrated circuit 200 is subsequently moved to a different location in the phased antenna array.

After the initialization process in which each remote beam control integrated circuit 20 is assigned an ID address, the central processing unit, which includes host computer 45 and beam steering computer 55, issues commands (CMD) globally to each remote beam control integrated circuit 20 over distributed serial bus 60. The central processing unit additionally globally transmits a synchronizing clock signal (CLK) and a transmit/receive enable signal to each remote beam control integrated circuit 20. First and second command (CMD) input gates 291 and 292 receive the globally transmitted commands (CMD), while clock input gate 293 receives the synchronizing clock signal, and transmit/receive enable input gate 294 receives the transmit/receive enable signal. As stated above, the commands, synchronizing clock signal, and the transmit/receive enable signal are preferably differential signals.

Figure 3:
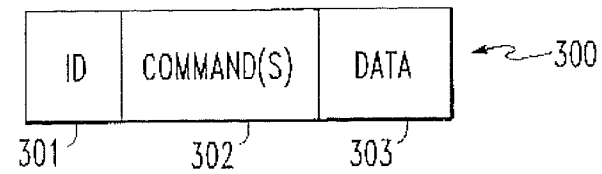
FIG. 3 is a diagram illustrating an exemplary data structure of a global command.

FIG. 3 shows an example of the format of a globally transmitted command 300. A typical globally transmitted command 300 includes an ID address field 301, a command field 302, and a data field 303.

Command decoder 210 receives all the globally transmitted commands and compares the associated ID address in the address field 301 of the global command 300 with the ID address stored in EEPROM 215. If the ID addresses are not the same, command decoder 210 ignores the commands and data stored in command field 302 and data field 303. On the other hand, if the ID addresses are the same, command decoder 210 determines that the global command is a local command to be executed locally, reads and decodes the command(s) in the command field 302, and then initiates the execution of the command(s).

An example of a command, which the central processing unit might send to the remote beam control integrated circuits, is a command to provide beam pulse shaping data stored in one of the first or second RAMs 230 and 235 to the antenna element associated with remote beam control integrated circuit 200. Beam pulse shaping data preferably includes phase, attenuation, and polarization data that may be directly used by the associated antenna element to adjust the phase, gain, or polarization of transmitted and/or received beams.

Upon receiving such a command, command decoder 210 instructs output control unit 240 to cause the beam pulse shaping data stored in one of the first and second RAMs 230 and 235 to be read out at a rate determined by output shift register 245, and to control first output MUX 250 and second output MUX 255 to provide a multiplexed output when required for the associated antenna element.

Another example of a command is a command to write beam pulse shaping data provided in the data field 303, into one of the first or second RAMs 230 and 235. Upon receiving such a write command, command decoder 210 instructs input control unit 220 to enable a selected one of the first and second RAMs 230 and 235 to store the beam pulse shaping data supplied thereto by input shift register 225.

When one of the first and second RAMs 230 and 235 is used to supply data to the antenna element, the other RAM may be selected to store newly received data. In this manner, beam pulse shaping data may be read out of one RAM while new beam pulse shaping data may be stored in the other RAM. Hence, the remote beam control integrated circuits may be programmed while active.

Yet another command is a command to adjust a delay introduced into the transmit and/or receive enable signals. When remote beam control integrated circuit 200 receives a command to adjust the delay, input shift register 225 transmits delay values provided in data field 303 to adjustable delay means 270. Adjustable delay means 270 permits the rising and falling edges of the transmit/receive enable signal to be delayed independently. Typically, a transmit/receive enable signal is a binary signal where one state enables an antenna element to transmit while the other state enables the antenna element to receive. This way, the antenna element cannot transmit and receive at the same time. However, some antenna elements cannot switch immediately from a transmit mode to a receive mode or from a receive mode to a transmit mode. By independently delaying the rising and falling edges of the transmit and/or receive enable signals, adjustable delay means 270 may introduce a lag time between the end of a transmit enable state and the beginning of a receive enable state, and may introduce the same or a different lag time between the end of a receive enable state and the beginning of a transmit enable state. Appropriate delays may be independently selected for the antenna element to which the remote beam control integrated circuit 200 is connected in order to optimize performance of the phased antenna array system by compensating for operating characteristics of the associated antenna element, such as module-to-mode delay differentials, and by compensating for antenna backplane skew.

Adjustable delay means 270 preferably includes a first transmit enable delay element 271, a second transmit enable delay element 272, a transmit enable flip-flop 273, a transmit (TX) enable output inverter gate 274, a first receive enable delay element 275, a second receive enable delay element 276, a receive enable flip-flop 277, a receive (RX) enable output inverter gate 278, a first switch delay element 280, a second switch delay element 281, a switch flip-flop 282, and first and second switch output inverter gates 283 and 284.

The transmit/receive enable signal is applied to the inputs of all of the delay elements. Each of the delay elements independently introduce a delay into the transmit/receive enable signal and provide the delayed signal to a flip-flop. The flip-flops may consist of D-type flip-flops where the output of one delay element is provided to the D input and the output of a second associated delay element is provided to the clock input. The delay elements are preferably programmable analog delay lines.

In addition to providing the transmit and receive enable signals to an antenna element, adjustable delay means 270 may provide switched outputs via first and second switch output inverter gates 283 and 284. The switched outputs may be used for special safety features, such as removing false RF emission.

Remote beam control integrated circuit 200 includes a temperature sensor 260 for sensing the temperature of the integrated circuit and providing a signal indicative of the sensed temperature to output control unit 240. When the sensed temperature exceeds a predetermined threshold level, output control unit 240 inhibits transmission and/or reception by the associated antenna element.

The remote beam control integrated circuit of the present invention may drive FET based phase shifters or PIN diodes of an associated antenna element.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An integrated circuit for use in controlling a phased array antenna system having a central processing unit, a respective said integrated circuit being associated with each one of a plurality of antenna elements of the phased array antenna system, said integrated circuit comprising:

an ID memory for storing a unique antenna element ID addressable by the central processing unit;

a command decoder coupled to said ID memory and receiving global commands from the central processing unit globally transmitted over a distributed serial bus, said command decoder comparing an ID address associated with the global commands with said ID stored in said ID memory and recognizing the global commands as local commands to be executed locally by the respective antenna element when the ID address associated with the global commands is the same as the ID stored in said ID memory; and processing means coupled to said command decoder for generating and supplying control signals to the respective antenna element in response to the local commands.

2. The integrated circuit of claim 1, further comprising:

beam pulse shape memory means for storing a plurality of sets of beam pulse shaping data for the respective antenna element, each set representing one of a plurality of beam pulse shapes; and beam pulse shape selecting means for selecting a set of beam pulse shaping data representing a beam pulse shape corresponding to an operating mode identified in the local commands from the central processing unit, wherein the control signals generated by said processing means include the selected set of beam pulse shaping data.

3. The integrated circuit of claim 2, wherein said beam pulse shape memory means comprises a pair of memories including first and second random access memories (RAMs) each storing one set of beam pulse shaping data, and wherein said beam pulse shape selecting means causes the set of beam pulse shaping data to be read out of a selected one of said first and second RAMs in response to a local command.

4. The integrated circuit of claim 2, wherein the beam pulse shaping data includes phase and attenuation data.

5. The integrated circuit of claim 2, wherein the beam pulse shaping data includes polarization data.

6. The integrated circuit of claim 2, further comprising:

beam data receiving means for receiving global beam pulse shaping data globally transmitted with the global commands from the central processing unit over the distributed serial bus, for recognizing the global beam pulse shaping data as local beam pulse shaping data when the ID address associated with the global beam pulse shaping data is the same as the ID stored in said ID memory, and for storing the local beam pulse shaping data in said beam pulse shape memory.

7. The integrated circuit of claim 6, wherein said beam pulse shape memory includes first and second random access memories (RAMs) each storing one set of beam pulse shaping data, and wherein said beam data receiving means causes a set of local beam pulse shaping data received from the central processing unit to be stored in a selected one of said first and second RAMs in response to a local command.

8. The integrated circuit of claim 7, wherein said beam pulse shape selecting means causes a set of beam pulse shaping data to be read out of a selected one of said first and second RAMs in response to a local command, the selected one of said first and second RAMs selected by said beam pulse shape selecting means being different from that selected by said beam data receiving means such that a set of beam pulse shaping data may be written into one of said first and second RAMs while a different set of beam pulse shaping data is read out of the other of said first and second RAMs.

9. The integrated circuit of claim 1, further comprising:

adjustable delay means for introducing a local delay into transmit and/or receive enable signals globally transmitted to all the antenna elements.

10. The integrated circuit of claim 9, wherein the amount of delay introduced corresponds to operating characteristics of the associated antenna element.

11. The integrated circuit of claim 1, further comprising:

a temperature sensor for sensing the temperature of the integrated circuit and providing a signal indicative of the sensed temperature; and inhibiting means for inhibiting transmission and/or reception by the associated antenna element when the temperature of the integrated circuit exceeds a predetermined threshold level.

12. The integrated circuit of claim 1, wherein said ID memory comprises a nonvolatile memory.

13. The integrated circuit of claim 12, wherein said ID memory comprises an EEPROM.

14. The integrated circuit of claim 1, further comprising:

means for receiving a synchronizing clock signal from the central processing unit, and for controlling the timing of operations of the integrated circuit in response thereto.

15. (Amended) An integrated circuit for use in controlling a phased array antenna system having a central processing unit, a respective said integrated circuit being associated with each one of a plurality of antenna elements of the phased array antenna system, said integrated circuit comprising:

an EEPROM for storing a unique ID for the respective antenna element and addressable by the central processing unit;

a command decoder receiving global commands from the central processing unit globally transmitted over a distributed serial bus, said decoder comparing an ID address associated with the global commands with said ID stored in said EEPROM, and recognizing the global commands as local commands to be executed locally for the respective antenna element when the ID address associated with the global commands is the same as the ID stored in said EEPROM;

a beam pulse shape memory for storing a plurality of sets of beam pulse shaping data for the respective element, each set representing one of a plurality of beam pulse shapes;

beam pulse shape selecting means for selecting a set of beam pulse shaping data representing a beam pulse shape corresponding to an operating mode identified in the local commands from the central processing unit; and processing means for generating and providing control signals, which include the selected set of beam pulse shaping data, to the respective antenna element in response to the local commands.

16. The integrated circuit of claim 15, further comprising:

a temperature sensor for sensing the temperature of the integrated circuit and providing a signal indicative of the sensed temperature; and inhibiting means for inhibiting transmission and/ór reception by said respective antenna element when the temperature of the integrated circuit exceeds a predetermined threshold level.

17. The integrated circuit of claim 15, further comprising:

adjustable delay means for introducing a respective local delay into transmit and/or receiving enable signals globally transmitted to all the antenna elements.

18. An integrated circuit for use in controlling a phased array antenna system having a central processing unit, a respective said integrated circuit being associated with each one of a plurality of antenna elements of the phased array antenna system, said integrated circuit comprising:

an ID memory for storing a unique antenna element ID addressable by the central processing unit;

a command decoder coupled to said ID memory and receiving global commands from the central processing unit globally transmitted over a distributed serial bus, said command decoder comparing an ID address associated with the global commands with said ID stored in said ID memory and recognizing the global commands as local commands to be executed locally for the respective antenna element when the ID address associated with the global commands is the same as the ID stored in said ID memory;

a first and a second beam pulse shape memory for storing a respective plurality of sets of beam pulse shaping data, each said set representing one of a plurality of beam pulse shapes;

beam pulse shape selecting means causing a set of beam pulse shaping data to be read out of a selected one of said first and second memories in response to a local command, the selected one of said first and second memories selected by said beam pulse shape selecting means being different from that selected by said beam data receiving means such that a set of beam pulse shaping data may be written into one of said first and second memories while a different set of beam pulse shaping data is read out of the other of said first and second memories; and processing means coupled to said command decoder for generating and applying control signals to the respective antenna element of the phased array antenna system in response to the local commands.

19. An integrated circuit for use in controlling a phased array antenna system having a central processing unit, a respective said integrated circuit being associated with each one of a plurality of antenna elements of the phased array antenna system, said integrated circuit comprising:

an ID memory for storing a unique antenna element ID addressable by the central processing unit;

a command decoder coupled to said ID memory and receiving global commands from the central processing unit globally transmitted over a distributed serial bus, said command decoder comparing an ID address associated with the global commands with said ID stored in said ID memory and recognizing the global commands as local commands to be executed locally for the respective antenna element when the ID address associated with the global commands is the same as the ID stored in said ID memory;

processing means coupled to said command decoder for generating and applying control signals to the respective antenna element of the phased array antenna system in response to the local commands.

a temperature sensor for sensing the temperature of the integrated circuit and generating a signal indicative of the sensed temperature;

inhibiting means coupled to said temperature sensor and being responsive to the signal generated thereby for inhibiting transmission and/or reception by the respective antenna element when the temperature of the integrated circuit exceeds a predetermined threshold level.

* * * * *